US005205669A

United States Patent [19]

Neff

[11] Patent Number: 5,205,669

[45] Date of Patent: Apr. 27, 1993

[54] ROTARY TROWEL FOR TROWELING POLYMER/AGGREGATE TOPPINGS ON SUBSTRATES

[75] Inventor: Michael Neff, Levittown, Pa.

[73] Assignee: Advanced Coatings, Inc., Sinking Spring, Pa.

[21] Appl. No.: 673,944

[22] Filed: Mar. 22, 1991

[51] Int. Cl.[5] ..... E01C 19/22

[52] U.S. Cl. ..... 404/97; 404/112

[58] Field of Search ..... 404/96–97, 404/112

[56] References Cited

U.S. PATENT DOCUMENTS 4,298,555 11/1981 Weltmer ..... 404/112 X
4,629,359 12/1986 Sengupta ..... 404/112
4,673,311 6/1987 Whiteman, Jr. ..... 404/112
4,848,960 7/1989 Kajioka et al. ..... 404/112
4,911,575 3/1990 Tidwell ..... 404/112 X

*Primary Examiner*—Ramon S. Britts
*Assistant Examiner*—Nancy P. Connolly
*Attorney, Agent, or Firm*—O'Keefe & Wilkinson

[57] ABSTRACT

A fluid driven adjustable speed rotary trowel for troweling a resin/aggregate topping over a substrate weighs not more than 40 pounds nor less than 20 pounds. The attack angle of the troweling blades is adjustable either manually or continuously and automatically by angle-sensing and adjusting means which is also fluid driven without the need to stop the trowel during operation. Aggregate/resin ratios of 5:1 or less will trowel to a smooth finish.

4 Claims, 4 Drawing Sheets

ROTARY TROWEL FOR TROWELING POLYMER/AGGREGATE TOPPINGS ON SUBSTRATES

CROSS-REFERENCES

There are no cross-references to, nor are there any, related applications.

FEDERALLY-SPONSORED RIGHTS

The invention herein was made without any Federal sponsorship or contribution.

BACKGROUND OF THE INVENTION

1. The Field of the Invention

The field of the invention relates to an improved powered rotary trowel for finishing environmentally resistant toppings applied over various substrates, such as concrete or wooden floors.

2. Description of the Prior Art

Various substrates, such as those made of poured concrete and the like, in many applications require a finish topping of an environmentally resistant material such as any epoxy resin and aggregate mixture. In applying such a finish, most applications are done by hand so as to ensure uniform topping thickness, film integrity as part of the topping, chemical resistance and aesthetic quality of the installation so as to keep the finish surface free of unsightly trowel marks. This exposes the worker to a substantial health hazard since close proximity to the aggregate/resin mixture during the hand troweling is required. The arduous conditions are further compounded by the need to work in a crouched or crawling position.

Attempts by workers to utilize devices and methods from the nearest related art, the use of self-propelled rotary trowels on booms for troweling concrete are quite unsatisfactory. While removing the worker from the fume area and allowing him to work upright at a reasonable speed, serious problems are created. The mass of apparatus typical for concrete troweling as taught in U.S. Pat. Nos. 2,662,454 (Dec. 1953 to Whiteman) and 4,198,178 (Apr., 1980 to Carlstrom et al (electric motors); 4,673,311 (Jun., 1987 to Whiteman) Goldblatt Tool Co., Kansas City, KS (internal combustion engine), all requiring heavy gear boxes, is about 92–250 pounds (42–110 kg). As a result, it is impossible to install a topping with a low aggregate/resin ratio, typically 5:1, as is commonly used in manual troweling since such a machine's mass will cause the trowel blades to leave unacceptable trowel marks that require repower troweling or extensive sanding after the topping has hardened. Consequently, aggregate ratios of 7 or 8:1 or higher are needed. Such ratios have diminished physical properties and aesthetic.

It should also be noted that combustion engines are not permitted to be used in food and drug manufacturing or processing sites and electric motors can cause explosions unless shielded in certain chemical atmospheres.

Further, the decorative value of these finished toppings where colored quartz is used as the aggregate cannot satisfactorily be maintained by neither heavy weight machine troweling nor by hand. This is caused by the introduction of a multiplicity of colors. Varigation creates visual problems for the manual installer since his eye cannot focus on trowel marks because of the multiplicity ofdd the colors. Further, the machine operator, as opposed to the manual artesan, cannot eliminate such marks since the quartzes included in the aggregate alter the topping composition to such an extent that a satisfactory finish is impossible. The machine trowel is no longer used for quartzes in the industry as a result.

It has been well recognized, due to the unpredictable nature of the topping setting during the installation process, that it would be useful to make the blade pitch and rotation speed variable during operation. The factors which influence this are, inter alia, aggregate/resin viscosity, ambient temperature, substrate temperature, square footage and the like. Variable pitch is taught by different means in, for example, '311 (Whiteman) above, and '980 (Morrison) above and U.S. Pat. No. 4,577,993 (Mar., 1986 to Allen, et al). It is believed that some require stopping the trowel to adjust for angle. None teaches a variable speed of rotation which is slow enough to provide a swirl free finish but rely on heavy duty gear boxes and throttles essentially to reduce the speed of the power source and regulate it to some extent. Such configurations only serve to exacerbate the problem by further increasing the mass significantly.

Prior art of interest, but which is deemed inapplicable, is USSR No. 146470 (Mar. 1961 to Kanyuka et al.) which depicts a pneumatic hand drill apparatus, useful in finishing plaster walls, to which is attached a rotary disc supporting trowel blades and a flowing water supply. Adaption of the apparent principal taught in USSR '470, rapid, wet smoothing of plaster screed or slip coats hardly would be applicable to finishing a aggregate/resin topping on a floor. Liquid flow for smoothing is desirable for plaster but not in the present application. Further, utilization and adaptation of such a device would scarcely be an improvement over hand troweling and is of too little mass to trowel a resinous topping.

It is well known in the industry that aggregate/resin mixtures of 5:1 or less will give superior toppings to the common 7–8:1 mixtures in use since the higher ratios of aggregate degrade the environmental resistance of the topping. By experimentation your inventor has found that a significant reduction in aggregate (to ratios of 5:1 and as low as 3:1) can be accomplished if the mass of the troweling device does not exceed about 40 pounds (18 kg). Further, it has been found that a mass of not less than about 20 pounds (9 kg) is necessary to maintain a useful finishing speed and a desirable finished effect.

SUMMARY OF THE INVENTION

An object of the present invention are to provide a light weight self-propelled rotary trowel and method which removes the worker from close proximity to the surface being finished, to provide a troweling device of a weight of approximately 20 to 40 pounds (9 to 18 kg) such that the aggregate/resin ration will be 5:1 or as little as 3:1 as opposed to the conventional 7–8:1 ratios now in use but is massive enough to trowel the mix. A further object is to provide a device with means for varying the pitch or attack angle of the trowel blades during operation without the need to stop and to provide a device which is of variable, defined speed of rotation so as to meet different topping and other conditions during finishing.

Accordingly, to accomplish the foregoing, the present invention is summarized as a variable-speed, fluid-driven, typically air, rotary trowel of a weight between 20 and 40 pounds in which optionally the air will be utilized automatically and continuously adjust the attack angle of the blades by means of angle controls built into the unit.

The trowel of the invention has a boom to which is attached a frame to hold typically a variable speed air motor and adjustable trowel blades. Trowel speed of rotation is controlled by panel means situated on a handle on the boom distally from the motor and blades. The blades are equipped either with a manual adjustment means usable during operation or a fluid-driven, typically air, continuous angle sensing means and adjusting means as directed from the panel.

Other objects, advantages and features of the present invention will be apparent to those skilled in the art from the following description taken in conjunction with the accompanying drawings.

DESCRIPTION OF THE DRAWINGS

The present invention may be better understood by reference to the drawings wherein 8 figures are shown on 4 sheets. The numbers shown on the drawings for the various parts of the invention are consistent throughout so that a number indicating a part in one drawing will indicate the same part in another drawing.

DESCRIPTION OF THE PREFERRED EMBODIMENT

Figure 1:
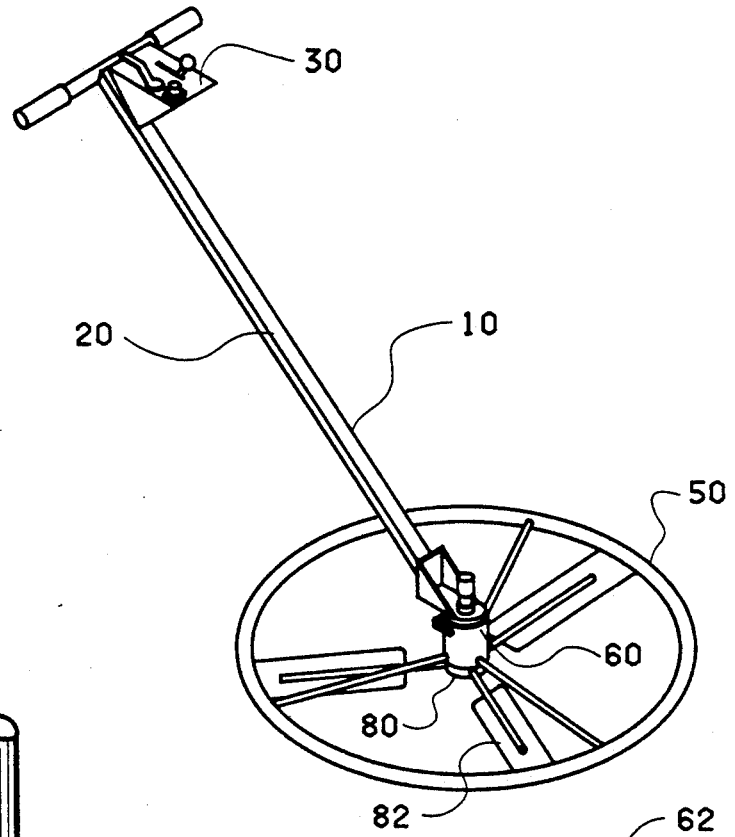
FIG. 1 is a generalized perspective view of the trowel of the invention showing an air motor drive.

The preferred embodiment of the invention is comprised of a light-weight, self-propelled rotary trowel 10 of a mass of not more than 40 nor less than 20 pounds, a boom assembly 20 which has a hand hold and control panel assembly 30 at an upper end of the boom assembly and a safety frame assembly 50 distally of the panel assembly. The frame assembly holds in an upright position, a variable-speed fluid driven motor assembly 60 in which typically the fluid is compressed air at 60 psi to drive rotatably a blade assembly 80 in intimate contact at a defined attack angle with a aggregate/resin topping on a substrate to trowel the topping. Cooperatively mounted with the blade assembly is a manual attack angle adjusting means 30 (See FIGS. 4 and 5) or in combination a continuous angle sensing and adjusting means described below which is controlled from a modified control panel 30*a* (See FIGS. 6 and 7).

Figure 2A:
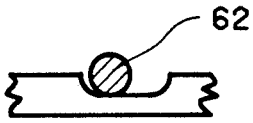
FIG. 2*a* is a side view of a portion of FIG. 2 through circle 2*a*.
Figure 2:
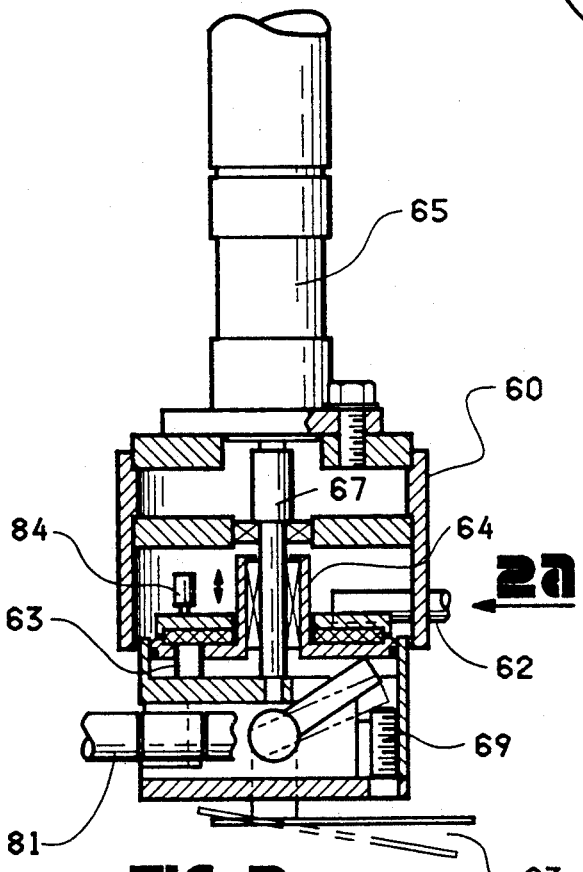
FIG. 2 is a cross sectional view of the air drive and blade adjustment means.
Figure 3:
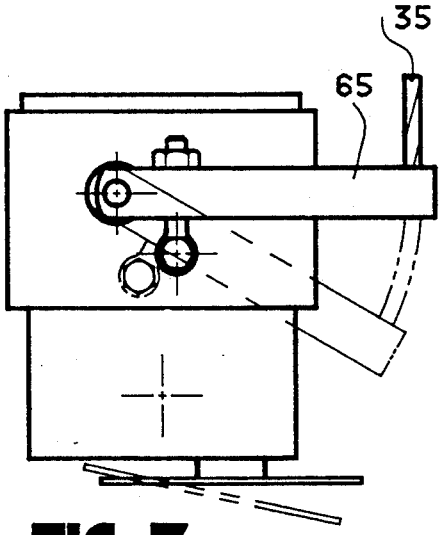
FIG. 3 shows a portion of a side view of FIG. 2 in which the manual angle adjustment of one of the preferred embodiments is shown.
Figure 4:
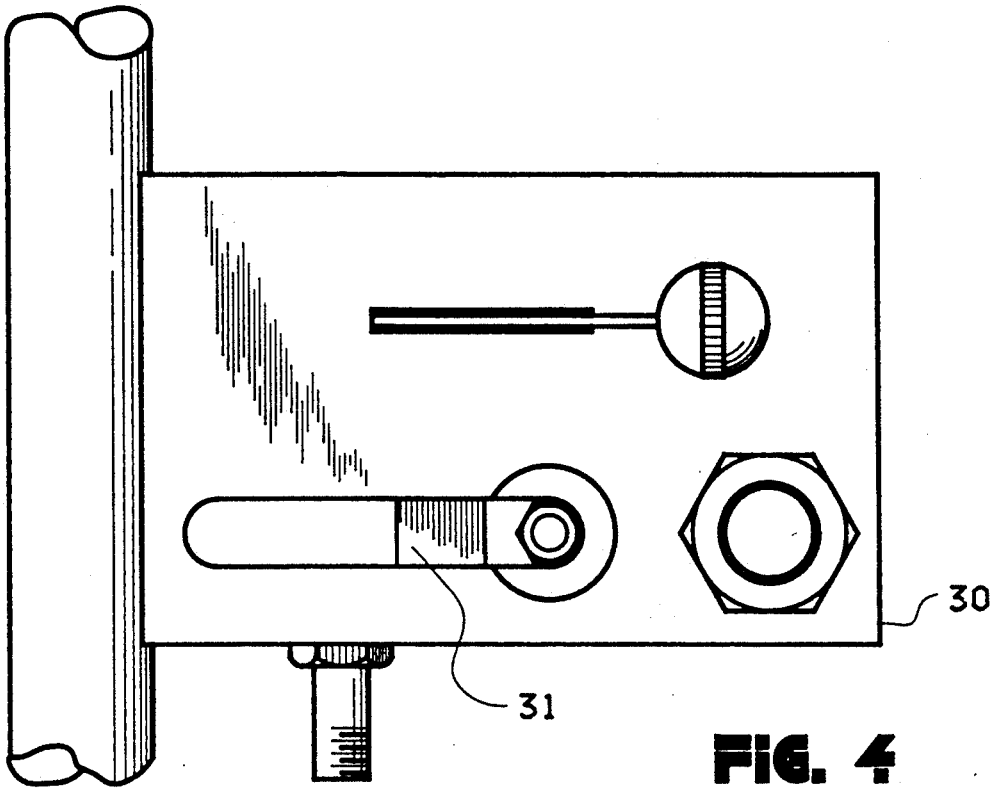
FIG. 4 is a typical control panel for the manual adjustment preferred embodiment.
Figure 5:
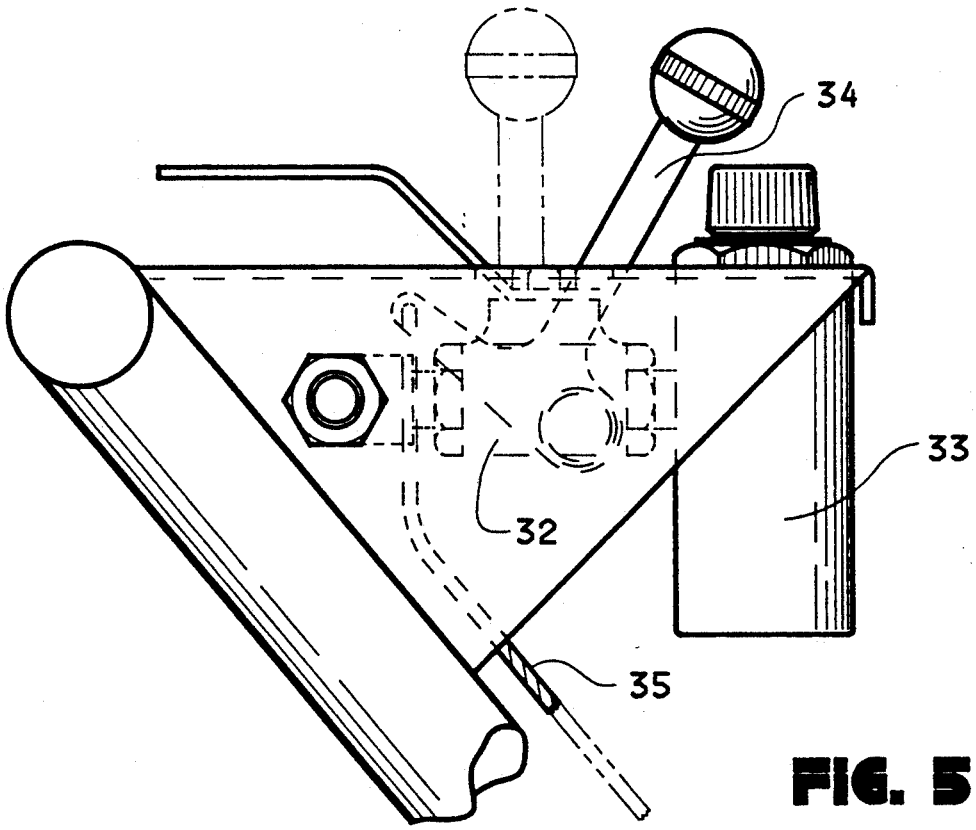
FIG. 5 is a side view of FIG. 4.

Attention is direction to FIGS. 3, 4 and 5. In a first preferred embodiment motor speed is manually adjusted by lever 31 which turns air valve 32 off and on and supplies compressed air through air pressure regulator 33 to the motor assembly 60. The attack angle of the blade assembly 80 is adjusted by the pivoting movement of first arm 34 (see FIG. 5) to release or take up a cable 35 which is connected to a second arm 61 situated on the motor assembly 60 such that adjusting bar 62 (FIGS. 2, 3) can move arcutuately (FIG. 2*a*) thereby permitting spring 63 loaded adjusting plate 64 to move vertically thereby rotating blade supports 81 attached to trowel blades 82 to an attack angle 83 as desired. Optionally, sensor 84, a linear potentiometer, will sense the angular change, for example as a voltage value and indicate this as an angular value on a meter 36, typically situated on the panel 30*a* shown in FIG. 7 in connection with the second preferred embodiment, but may be readily installed on panel 30. The means by which angular adjustment is made to maintain constancy is discussed below.

Air motor 65 is disposed superiorly to air motor assembly housing 66 such that shaft 67 passes through plate 64 and bushing 68 such that shaft rotation does not interfere with the vertical motion of the adjusting plate. Each blade 82 may be set to a zero attack angle by means of adjusting screw 69 before troweling is begun.

Figure 7:
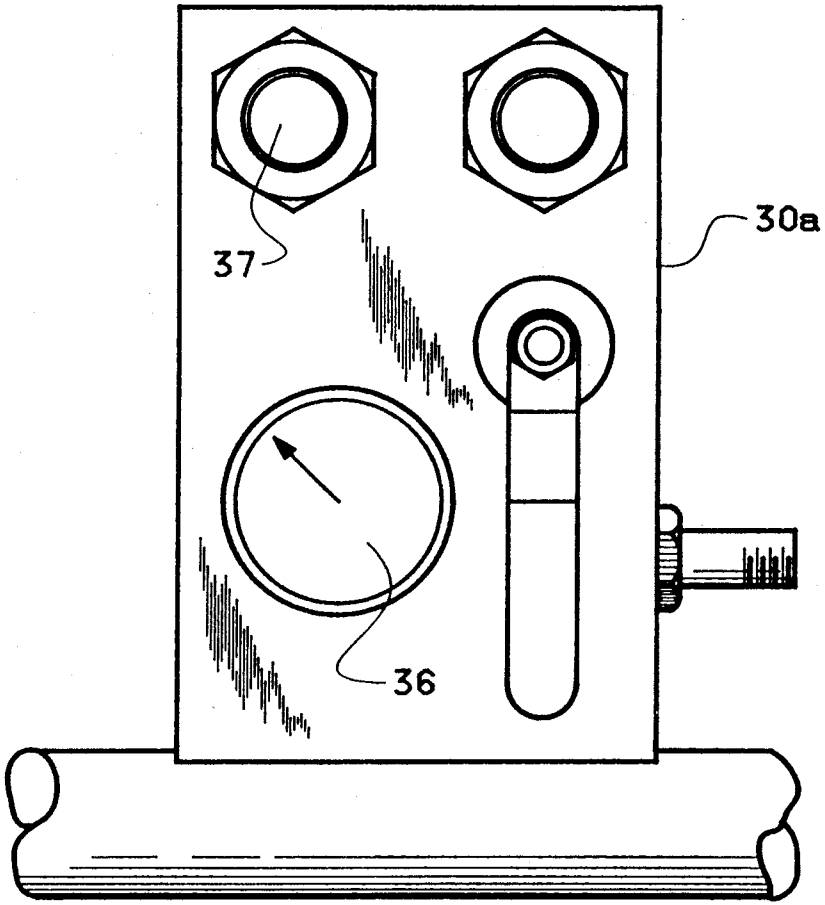
FIG. 7 is a plan view of a control panel of the second preferred embodiment.
Figure 6:
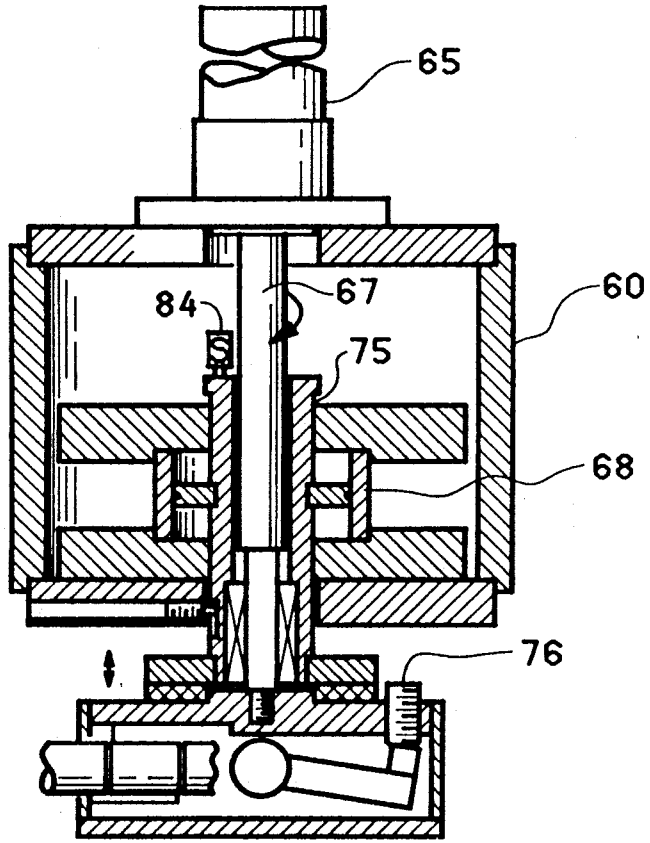
FIG. 6 is a cross-sectional elevation view of the air drive and angle adjustment means in the preferred embodiment in which the attack angle may be adjusted continuously.
Figure 8:
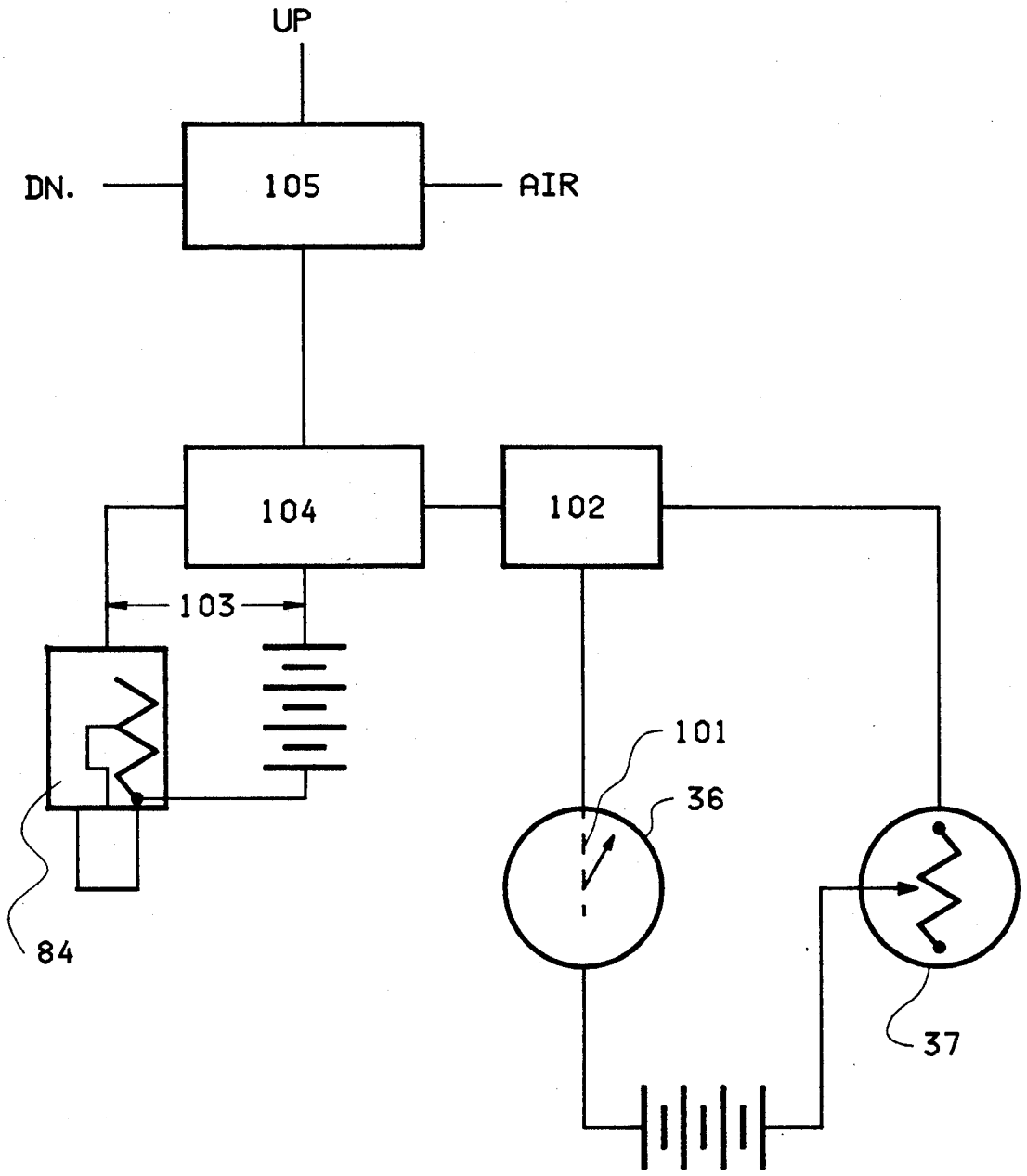
FIG. 8 is a schematic diagram of a typical angle adjusting circuit useful in connection with the apparatus depicted in FIG. 6.

The second preferred embodiment accomplishes attack angle adjustment automatically and continuously as shown in FIGS. 6, 7 and 8. Air motor 65 is disposed on housing 70, and has a shaft 67 passing through an air driven angle adjusting cylinder 68 in such a way as not to interfere with said cylinder. The angle adjusting cylinder is equipped with piston 71, a downstroke inlet port (not shown) and an upstroke inlet port (not shown). Sensor 84, a linear potentiometer, will sense the motion of plate 74 attached to an adjustment sleeve 75 typically as a voltage to be indicated on the angle meter 36.

Angular adjustment is first made by means of calibrating adjustment screw 76 to set the angle meter at zero and then rotating knob 37 to set a desired defined angular value as shown in meter 36.

Attention is directed to FIG. 8. The desired defined angular value shown on the meter represents a first voltage 101 which is stored 103 and compared with a second voltage 102 found in comparator circuit 104 taken from sensor 84 such that air through flow control 105 is admitted through the upstroke or downstroke port until the second comparator circuit voltage value is equal to the first defined voltage, the desired angle. As topping setting and other conditions change, air supply is increased or decreased to correct the attack angle accordingly.

Since many modifications, variations and changes in detail may be made to the presently described embodiment, it is intended that all matters in the foregoing description and accompanying drawings be interpreted as illustrative and not by way of limitation.

I claim:

1. A light weight rotary power trowel with a multiplicity of rotating troweling blades which have an attack angle which is adjustable relative to a surface for finish troweling a movable aggregate/-resin topping on a substrate comprising:

(a) a boom having an upper end and a lower end with a hand hold disposed transversely to the upper end;

(b) attack angle adjustment means;

(c) a panel with controls situated on the hand hold for operating the trowel and the attack angle adjusting means;

(d) a safety frame attached to the arm's lower end for holding (1) a fluid driven adjustable speed rotary motor with a shaft to which are attached the troweling blades disposed equiangularly and radially about the shaft, each blade being planarly rectangular and having a major attack surface adjacent to and in contact with the movable topping so as to form therewith the attack angle;

(d) control means situated on the panel in cooperative contact directingly with the attack angle adjusting means;

(e) the rotary trowel being of a mass not greater than about 40 pounds nor less than about 20 pounds.

2. A lightweight rotary trowel as in claim 1 wherein the fluid which drives the motor is compressed air at not less than 60 psi.

3. A lightweight rotary trowel as in claim 1 wherein the means for varying and adjusting the attack angle are operable during continuous rotation of the blades.

4. A lightweight rotary trowel as in claim 3 wherein the attack angle is adjustable by a fluid driven cylinder responsive to a sensed voltage generated by the attack angle and continuously compared to a voltage representing a defined attack angle selected by an operator of the trowel.

* * * * *